US005221087A

United States Patent [19]

Fenton et al.

[11] Patent Number: 5,221,087

[45] Date of Patent: Jun. 22, 1993

[54] METAL GOLF CLUBS WITH INSERTS

[75] Inventors: Frank Fenton, South Hadley, Mass.; Daniel A. Melanson, Avon, Conn.

[73] Assignee: Lisco, Inc., Tampa, Fla.

[21] Appl. No.: 823,806

[22] Filed: Jan. 17, 1992

[51] Int. Cl.[5] ..... A63B 53/04

[52] U.S. Cl. ..... 273/173; 273/167 H; 273/167 J

[58] Field of Search ..... 273/167-175, 273/79, 193 R, 194 R, 77 R, 77 A

[56] References Cited

U.S. PATENT DOCUMENTS

| | | | |
|---|---|---|---|
| 1,135,621 | 4/1915 | Roberts | 273/79 |
| 1,253,700 | 1/1918 | McLaughlin | 273/77 A |
| 2,530,446 | 11/1950 | Beardsley | 273/168 |
| 3,220,733 | 11/1965 | Saleeby | 273/171 |
| 3,368,812 | 2/1968 | Baldwin | 273/173 X |
| 3,975,023 | 8/1976 | Inamori | 273/173 |
| 4,023,802 | 5/1977 | Jepson et al. | 273/174 X |
| 4,681,322 | 7/1987 | Straza et al. | 273/173 |
| 5,024,437 | 6/1991 | Anderson | 273/78 |

FOREIGN PATENT DOCUMENTS

| | | | |
|---|---|---|---|
| 211781 | 12/1957 | Australia | 273/167 J |

*Primary Examiner*—William H. Grieb
*Assistant Examiner*—Sebastiano Passaniti

[57] ABSTRACT

A wood type golf club formed of a shaft and head assembly, the head assembly including a hollow main body portion and an insert coupled thereto along the majority of its periphery by a dovetail to preclude lateral and downward movement of the insert with respect to the main body portion, the main body portion having a ramp extending outwardly from its face with the adjacent face of the insert having a recess positioned to receive the ramp thereby precluding the movement of the insert upwardly away from the main body portion and further including an adhesive coupling the insert to the main body portion.

8 Claims, 3 Drawing Sheets

METAL GOLF CLUBS WITH INSERTS

BACKGROUND OF THE INVENTION

1. Field of the Invention

The present invention relates to metal golf clubs with inserts and, more particularly, to a wood type golf club investment cast of metal with thin walls and having a recessed area in the face for the receipt of an insert secured by adhesive and mechanical constructions.

2. Description of the Background Art

It has long been the practice to construct golf clubs of a shaft and a club head coupled together. The club head for wood type golf clubs is normally enlarged with a striking face for contacting the ball during a hit. The striking face is frequently constructed of an insert fabricated of a material different than the main body portion of the club head. In this manner, the majority of the club head may be fabricated of a first material by a technique to maximize strength and minimize weight. In association therewith, an insert may be fabricated of a second material, sized and shaped to maximize the forces transferred to the ball during the hit for providing the maximum propelling of the ball from the club head.

A wide variety of prior art patents disclose club heads with inserts including various techniques for coupling the inserts to the main body portion of the club head. By was of example U.S. Pat. No. 4,630,826 to Nishigaki discloses the use of alternating layers of material bonded or otherwise adhered together to form a unitary club head. In addition, U.S. Pat. No. 4,804,188 to McKee discloses the use of screws and grooves for securing together a face plate with a main body portion of a wood type golf club head. Other patents of interest include U.S. Pat. Nos. 4,792,140 and 4,809,978 both to Yamaguchi which disclose golf club heads with inserts formed with dovetail peripheries and additional securement means including screws. Lastly, U.S. Pat. No. 5,024,437 to Anderson discloses the use of an insert with a projection positionable in a recess formed in the main portion of the golf club head and with the insert welded to the main portion of the golf club head.

Other patents of interest include U.S. Pat. Nos. 3,937,373 and 4,023,802 to Jepson; 3,975,023 to Inamori; 4,681,322 to Straza; 4,730,830 to Tilley; 4,801,146 and 4,812,187 to Honma; 4,917,384 to Caiati and 4,984,800 to Hamada.

No prior disclosure teaches or suggests the present inventive concept of an insert coupled to the main body portion of the golf club head through a ratchet type coupling, a dovetail periphery and an adhesive therebetween.

Therefore it is an object of the present invention to provide a wood type golf club formed of a shaft and head assembly, the head assembly including a hollow main body portion and an insert coupled thereto along the majority of its periphery by a dovetail to preclude lateral and downward movement of the insert with respect to the main body portion, the main body portion having a ramp extending outwardly from its face with the adjacent face of the insert having a recess positioned to receive the ramp thereby precluding the movement of the insert upwardly away from the main body portion and further including an adhesive coupling the insert to the main body portion.

Another object of the present invention is to couple an insert to a golf club head through a ratchet type coupling.

Another object of the present invention is to employ a locking ramp and a generally U-shaped periphery with dovetails for securing an insert to the face portion of the golf club.

It is a further object of the present invention to use an adhesive to couple an insert to a golf club in association with mechanical securement means.

It is further object of the present invention to fabricate a wood type golf club head more efficiently.

The forgoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The present invention is defined by the appended claims with the specific embodiment shown in the attached drawings. For the purpose of summarizing the invention, the invention may be incorporated into a wood type golf club formed of a shaft and head assembly, the head assembly including a hollow main body portion and an insert coupled thereto along the majority of its periphery by a dovetail to preclude lateral and downward movement of the insert with respect to the main body portion, the main the adjacent face of the insert having a recess positioned to receive the ramp thereby precluding the movement of the insert upwardly away from the main body portion and further including an adhesive coupling the insert to the main body portion.

The invention may also be incorporated into a golf club head assembly formed of a main body portion and an insert, mechanical means to couple the main body portion and insert, the mechanical means including peripheral dovetails and a wedge functioning as a ratchet. The wedge is centrally located in the face of the main body portion. The mechanical means also includes a recess in the face of the insert facing the wedge for the receipt thereof. The wedge has an essentially horizontal lower face in contact with an essentially horizontal lower face in the recess. The assembly further includes mating dovetails around the majority of the periphery of the adjacent edges of the insert and the main body portion. The insert includes a plurality of vertical recesses for receiving an adhesive. The assembly is a wood type head with a hollow main body portion.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference numerals refer to similar parts throughout the several views of the drawings.

DETAILED DESCRIPTION OF THE PREFERRED EMBODIMENT

Figure 1:
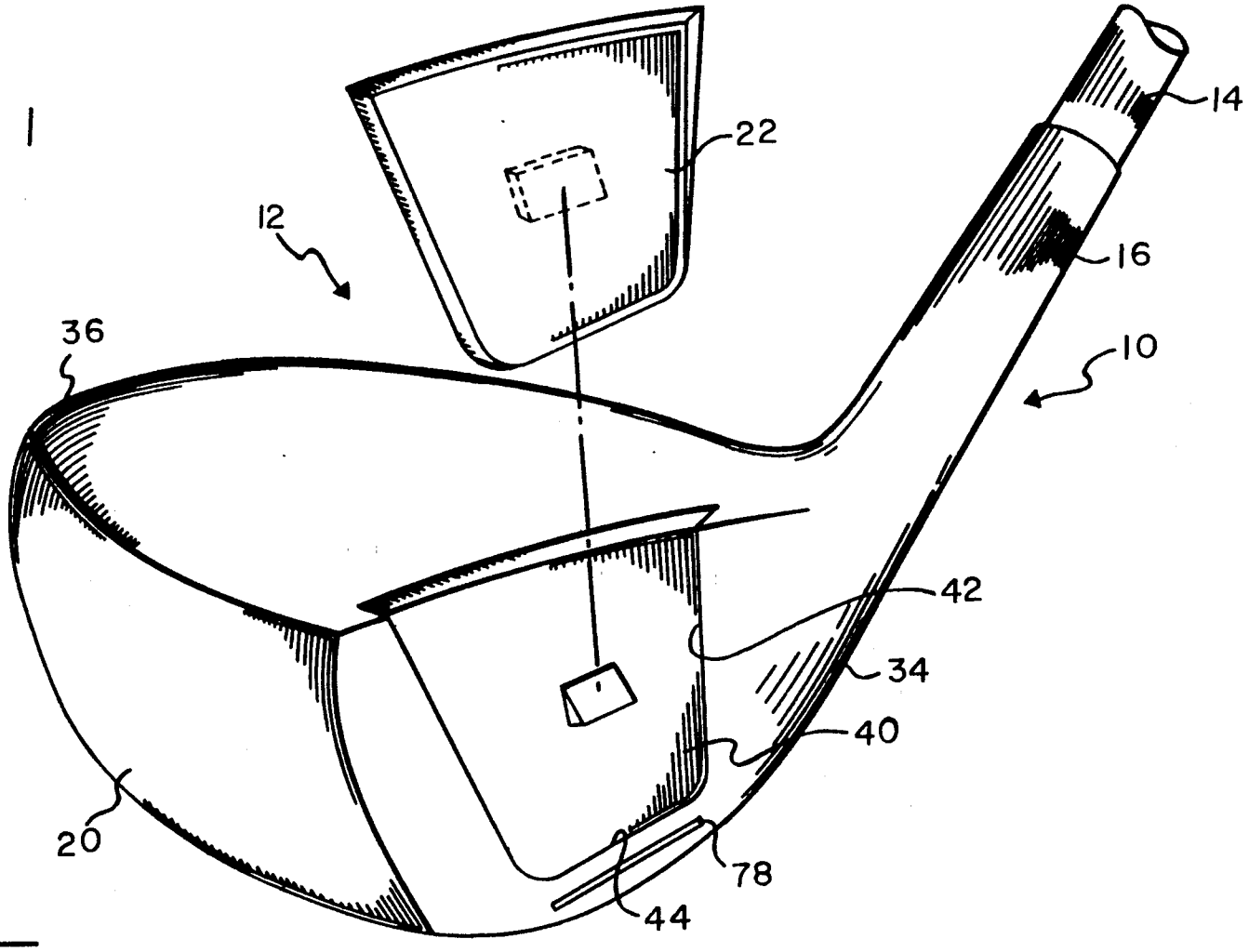
FIG. 1 is an exploded perspective illustration of a golf club head constructed in accordance with the principals of the present invention.
Figure 2:
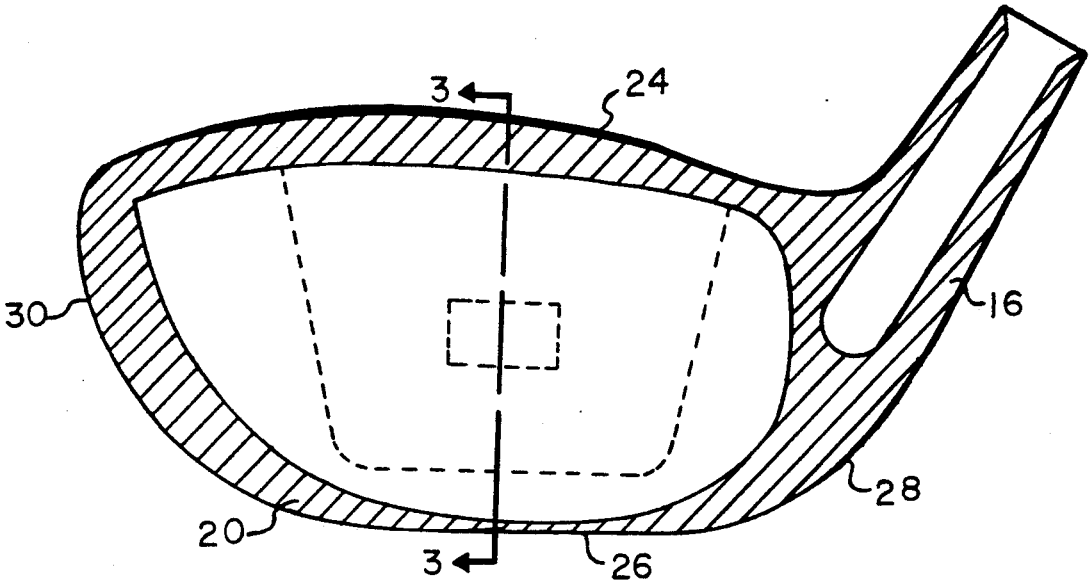
FIG. 2 is a sectional view taken through a vertical plane through the center of the hosel.

Shown in FIG. 1 is a golf club 10 with a head assembly 12 constructed in accordance with the principals of the present invention. The golf club 10 includes a shaft 14 and the head assembly 12. The shaft 14, only a portion of which is shown in FIG. 1, includes a first or handle end, not shown, but conventional, for being held by the user and a second end for being secured to the club head through the hosel.

The head assembly 12 is formed of a main or major body portion 20 and an insert portion 22. The main body portion 20 includes an upper surface 24 and a sole 26 constituting the bottom surface. At the end of the head adjacent to the hosel is the heel 28. The toe 30 is the end remote therefrom. The generally planar ball striking surface is adjacent to face 34 while the rear 36 is located opposite remote therefrom. The club head assembly 12 through the majority of its extent is hollow. This renders the club head of a thin wall construction.

Figure 3:
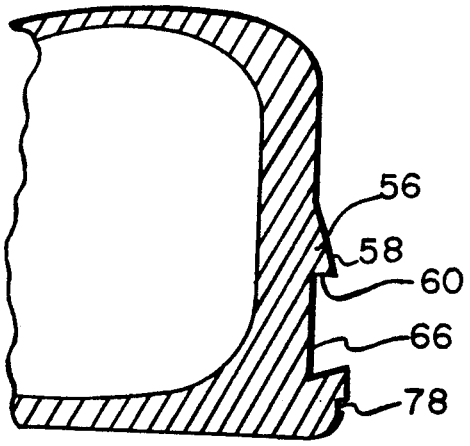
FIG. 3 is a sectional view taken through section line 3—3 of FIG. 2.
Figure 4:
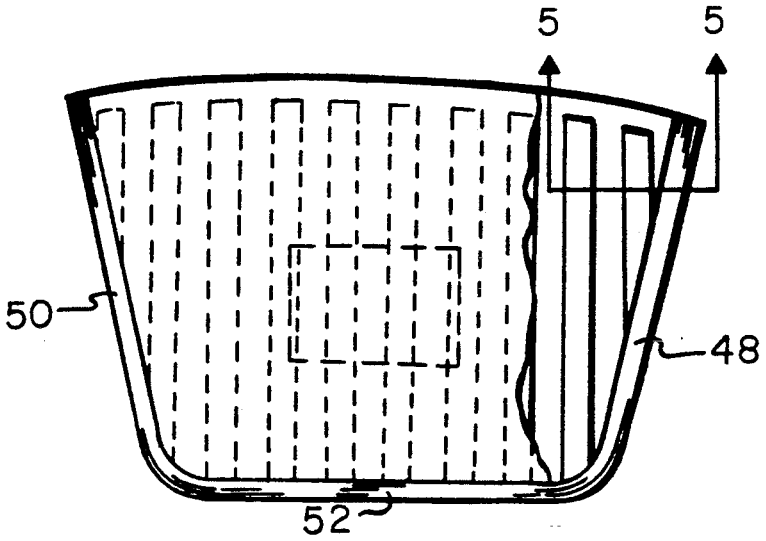
FIG. 4 is an elevational view of the insert with parts broken away to show certain internal construction.
Figure 5:
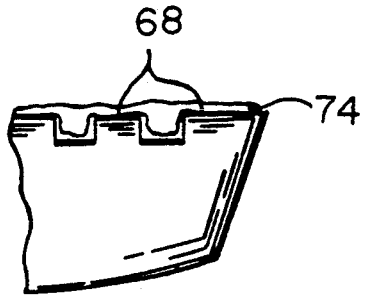
FIG. 5 is a sectional view taken along section line 6—6 of FIG. 4.
Figure 6:
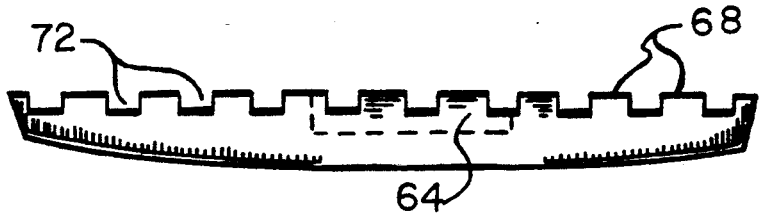
FIG. 6 is a plan view of the insert shown in FIGS. 4 and 5.

The face region 34 of the major portion of the club head assembly is generally planar in its configuration, top to bottom and side to side. Note FIGS. 1 and 3. The periphery 20 of the planar portion of the face is adapted to receive the insert portion 22 of the head assembly 12 and is provided with dovetail recesses from the upper edge thereof extending down the sides 42 and across the lower face 44. The recesses are angled at about 75 to 80 degrees from the vertical. The recesses form a generally U-shaped configuration but tapering inwardly on the face from top to bottom. The edges of the periphery, except across the top, are formed at such angle to correspond to the angle at the adjacent periphery 48 of the insert 22, with sides 50 and bottom 52, to maximize the coupling therebetween and preclude the insert from moving away from its supporting face in the club head.

Additional mechanical coupling is effected by an insert ramp or wedge 56 extending outwardly from the front face of the main body portion of the club head assembly. The insert wedge 56 has an angled rectangular face 58 projecting outwardly from top to bottom. The lower surface 60 thereof is generally horizontal while the face thereabove is angled at about 15 to 20 degrees from the vertical. It extends from top to bottom about 15 to 25 percent of the insert and from side to side about 20 to 30 percent of the insert. This corresponds in size to a recess opening 64 of a rectangular box shaped configuration on the face of the insert.

The club face of the main body portion is formed with a flat surface 66 positionably in contact with a flat adjacent back face 68 of the insert. The exterior or ball striking face bows outwardly slightly with what is known as face "roll and bulge radius" as is conventional in the art. Grooves may be formed therein as is conventional. In addition, a plurality of vertical, rectangular recesses 72 are formed in the central extent of the rear face of the insert for receiving an adhesive further coupling the insert to the face of the main body portion. This allows adhesive 74 of sufficient quantity at the interface between the adjacent surfaces of the main body portion and the insert. Beneath the insert, the club head is formed with a horizontal alignment groove 78.

When coupling the insert to the club head, an adhesive is first coated onto the flat face of the main body portion as well as the adjacent flat surface of the insert and into the parallel recesses. The lower edge of the insert is placed adjacent the upper edge of the recess of the club head and the insert is slid downwardly. The wedge functions as a ramp to temporarily force the insert to bow outwardly away from the face during installation. The dovetail shaped periphery will assist in holding the insert at a location generally adjacent to the club head. Further downward motion of the insert will continue until the protruding ramp is located in the recess at the rear face of the insert at which time the insert will spring back or resile to its normal generally planar configuration to constitute a ratchet type coupling. At such time the adhesive between the club head and insert will have been spread evenly over the adjacent faces and into the vertical recesses for maximum coupling. Together, the mechanical coupling effected by the dovetails will secure the insert to the club head against separation movement in all direction except upwardly. The upward motion of the insert with respect to the club head is precluded by the configuration of the insert wedge in the recess which functions as a ratchet with the lower horizontal surface of the wedge in facing contact with the horizontal lower surface of the insert recess. Lastly, the adhesive, when cured, will preclude any motion of the insert with respect to the club head.

Preferred materials for the main portion of the club head include steel, aluminum, aluminum alloys, silicon-/aluminum alloys and the like fabricated by investment casting or other suitable process. Preferred materials for the insert include fiber reinforced plastics, thermoplastic resins, urethanes, composite urethanes and the like. The adhesive is preferably an epoxy resin or the like.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of structures and the combination and arrangement of parts may be resorted to without departing from the spirit and scope of the invention.

Now that the invention has been described,

What is claimed is:

1. A wood type golf club formed of a shaft and head assembly, the head assembly including a hollow main body portion having an insert-receiving exterior face having a periphery and an insert for stroking a golf ball, the insert having an interior face, an exterior face and a periphery turnaround, the insert being coupled to the main body portion along the majority of the periphery of the exterior face of the main body portion by a dovetail to preclude material and downward movement of the insert with respect of the main body portion, the exterior face of the main body portion having a ramp extending outwardly therefrom, the interior face of the insert having, within the periphery of the insert, a recess positioned to receive the ramp thereby precluding the movement of the insert upwardly away from the main body portion and further including an adhesive coupling the insert to the main body portion.

2. A golf clubhead assembly formed of a main body portion with ah insert-receiving exterior face and an insert for striking a golf ball, said insert having an interior face, said assembly further including mechanical means to couple to the main body portion to the insert, the mechanical means including a mating peripheral dovetail arrangement between said main body portion and said insert and a wedge having an angled outwardly projecting face located within the boundaries of the peripheral dovetail arrangement and further including a recess for matingly receiving said projecting face.

3. The assembly as set forth in claim 2 wherein the wedge is centrally located on the exterior face of the main body portion.

4. The assembly as set forth in claim 3 wherein the recess is located in the interior face of the insert facing the wedge for the receipt thereof.

5. The assembly as set forth in claim 4 wherein the wedge has an essentially horizontal lower face positioned in contact with an essentially horizontal lower face in the recess.

6. The assembly as set forth in claim 5 wherein the insert has peripheral edges and the main body portion has peripheral edges and further including mating dovetails around the majority of the peripheral edges of the insert and the main body portion.

7. The assembly as set forth in claim 6 wherein the insert includes a plurality of vertical recesses for receiving an adhesive.

8. The assembly as set forth in claim 7 wherein the assembly is a wood type head with a hollow main body portion.

* * * * *